US005302138A

United States Patent [19]

Shields

[11] Patent Number: 5,302,138

[45] Date of Patent: Apr. 12, 1994

[54] ELECTRICAL COUPLER WITH WATERTIGHT FITTING

[76] Inventor: Winston E. Shields, 8612 W. 127th St., Palos Park, Ill. 60464

[21] Appl. No.: 21,003

[22] Filed: Feb. 22, 1993

Related U.S. Application Data

[63] Continuation-in-part of Ser. No. 853,282, Mar. 18, 1992.

[51] Int. Cl.[5] ..... H01R 13/52

[52] U.S. Cl. ..... 439/527; 439/559; 439/565

[58] Field of Search ..... 174/65 SS; 285/152, 285/154; 439/527, 542, 544, 550, 557, 556, 559, 564, 565

[56] References Cited

U.S. PATENT DOCUMENTS 5,051,541 9/1991 Bawa et al. ..... 174/65 SS
5,129,684 7/1992 Lawrence et al. ..... 285/192 X

FOREIGN PATENT DOCUMENTS 2125131 2/1984 United Kingdom ..... 285/192

*Primary Examiner*—Eugene F. Desmond
*Attorney, Agent, or Firm*—Emrich & Dithmar

[57] ABSTRACT

An electrical coupler is adapted for connecting a multi-lead cable to circuitry, such as a senor circuit, in a closed housing. The coupler includes an inner threaded multi-pin quick disconnect cable connector disposed within a barbed cylindrical hose fitting which is inserted in an aperture in a housing wall and forms a watertight seal about the aperture. A reinforcing plate may be attached to the hose fitting on the inner surface of the housing wall to strengthen the installation. A vinyl or rubber hose is affixed to the barbed end of the hose fitting by means of a suitable clamp to environmentally seal the inner electrical connector from liquid and gas containments. The electrical coupler is easily disconnected such as for connecting another senor to the cable and provides a fluid-proof, rugged, quick disconnect electrical coupling through a solid structure such as a wall.

18 Claims, 6 Drawing Sheets

Fig. 12a
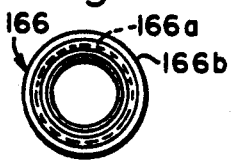
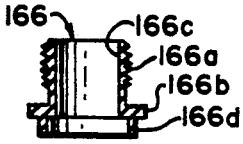
Fig. 12b
Fig. 13a
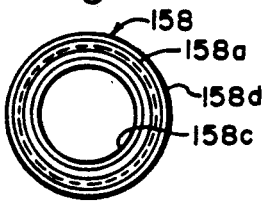
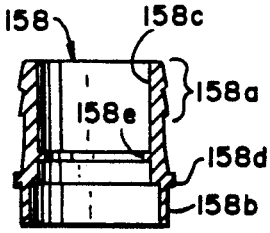
Fig. 13b
Fig. 9
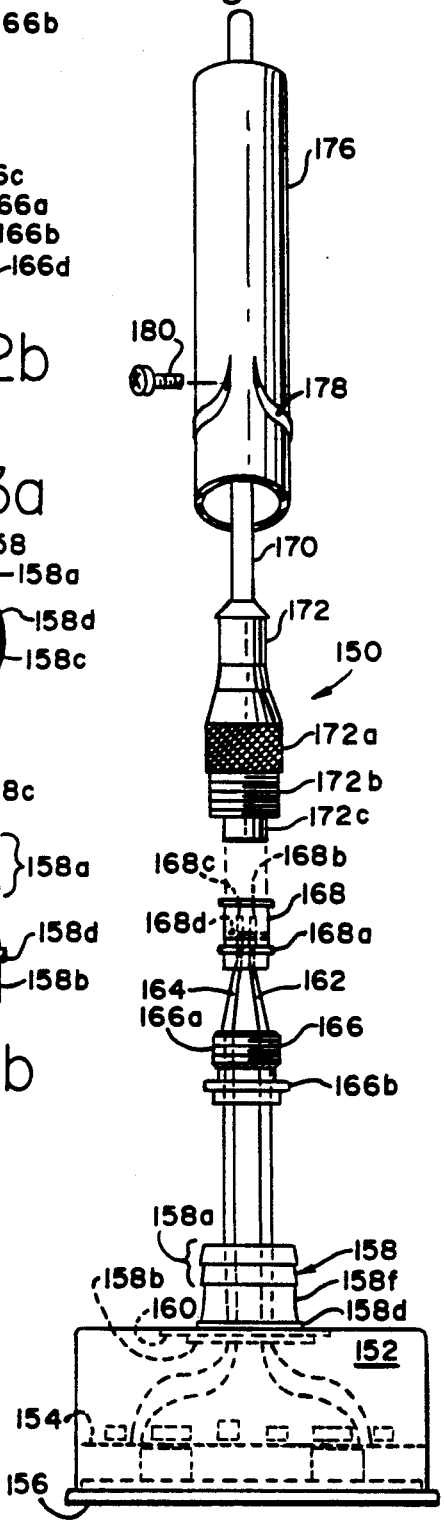
Fig. 10
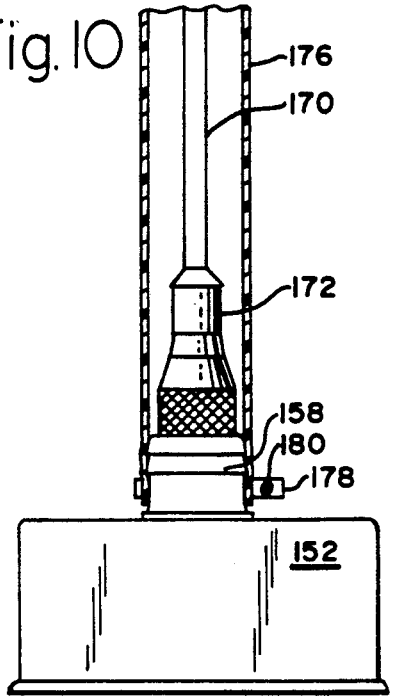
Fig. 11
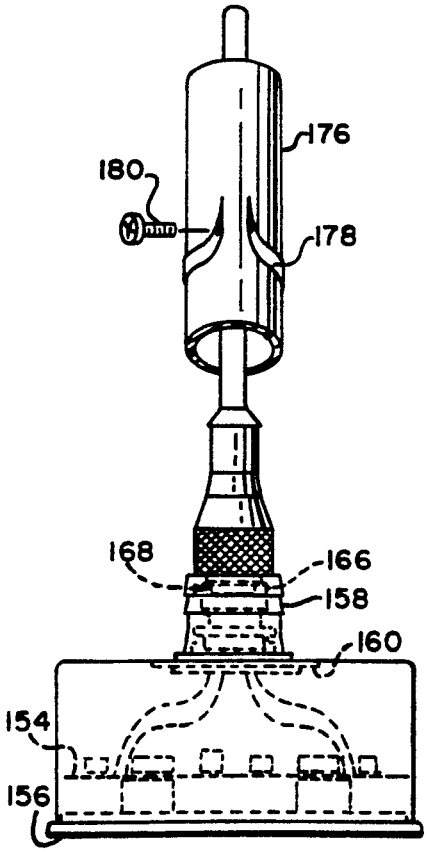

ELECTRICAL COUPLER WITH WATERTIGHT FITTING

CROSS-REFERENCE TO A DATED APPLICATION

This application is a continuation-in-part of application Ser. No. 853,282, filed Mar. 18, 1992 in the name of the present inventor.

FIELD OF THE INVENTION

This invention relates generally to liquid tight electrical couplers and is particularly directed to a ruggedized, sealed quick disconnect coupling arrangement for connecting an electrical lead to circuitry within a housing.

BACKGROUND OF THE INVENTION

An electrical circuit disposed within a closed housing is typically connected through the housing to appropriate external circuitry such as a power supply or a data/-control signal source or processing circuit. The electrical circuit is generally enclosed in a housing to isolate it from the environment, insulate it from other circuits and conductors, and mechanically protect it from impact damage. An electrical lead typically extends through an aperture in the housing and is connected to circuitry within the housing. The lead may also be coupled to an external cable by a suitable connector. Frequently several leads extend through the housing's aperture and are coupled to a multi-lead cable via a multi-pin connector. An O-ring may be inserted in the aperture of the housing and disposed about the leads or cable to provide a limited seal for the leads and circuitry within the housing and to protect the leads from damage by contacting that portion of the housing defining the aperture through which the leads extend. This arrangement affords only limited cable protection and isolation of the internal circuitry from the environment external to the housing. For example, this arrangement is subject to leakage of moisture and other contaminants into the housing as well as impact damage to the cable and connector extending from the housing. Where a conduit connector extends from the housing, a potting compound is frequently incorporated in the connector to fill voids therein. This increases the cost of the installation and still does not ensure a leak-free connection.

The present invention addresses the aforementioned problems of the prior art and by providing a ruggedized, environmentally sealed, liquid tight quick disconnect electrical coupler for a cable extending through an aperture in a housing containing electrical circuitry.

OBJECTS AND SUMMARY OF THE INVENTION

Accordingly, it is an object of the present invention to provide a ruggedized, liquid-tight sealed detachable coupling arrangement for an electrical cable.

It is another object of the present invention to provide a sealed coupler for connecting an electrical cable to circuitry within a generally closed housing which protects the cable from mechanical damage while allowing the cable to be easily and quickly disconnected from the housing.

Yet another object of the present invention is to provide a quick disconnect coupling arrangement for a multi-lead electrical cable, or cord, which is comprised of a minimum number of components, protects the cable from mechanical damage, and insulates the cable and electrical connection from moisture and foreign material.

A further object of the present invention is to environmentally seal, from liquid and gas contaminants a multi-pin electrical connector employed in a hostile environment.

This invention contemplates a quick disconnect, watertight electrical coupler for connecting an electrical cable to leads from a sensor circuit within a housing, the electrical coupler comprising a hose fitting coupled to the housing and disposed about an aperture in the housing for forming a seal with the housing, wherein the sensor leads pass through the aperture in the housing and are disposed within the hose fitting. The hose fitting has a cylindrical body with an end portion having a plurality of circumferential barbs disposed in a spaced manner along a portion of the length of hose fitting outside of the housing. The electrical coupler further includes a hose disposed about the electrical cable for forming a watertight seal about the electrical cable, wherein an end of the hose is inserted over and securely engages the barbs on the hose fitting. A clamp securely engages the hose intermediate the barbed end portion of the hose fitting and the housing for forming a watertight seal between the hose and the hose fitting. A quick disconnect coupler provides for connecting the electrical cable to the sensor leads. A connector housing couples the sensor leads to the quick disconnect coupler, wherein the connector housing is in sealed engagement with the hose fitting and quick disconnect coupler and engages and maintains the sensor leads in fixed position within the electrical coupler.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 9 is an exploded side elevation view shown partially in phantom of an electrical coupler with a watertight fitting in accordance with the present invention;

FIG. 10 is an side elevation view of the electrical coupler of the present invention showing the connector assembled with the connector's outer hose shown in section;

FIG. 11 is a side elevation view of an assembled electrical coupler with watertight fitting in accordance with the present invention showing various inner components of the connector in phantom;

FIGS. 12*a* and 12*b* are respectively plan and vertical sectional views of a connector housing for use in the electrical connector of the present invention; and FIGS. 13*a* and 13*b* are respectively plan and vertical sectional views of a barbed hose fitting for use in the electrical connector of the present invention.

DETAILED DESCRIPTION OF THE PREFERRED EMBODIMENTS

Figure 1:
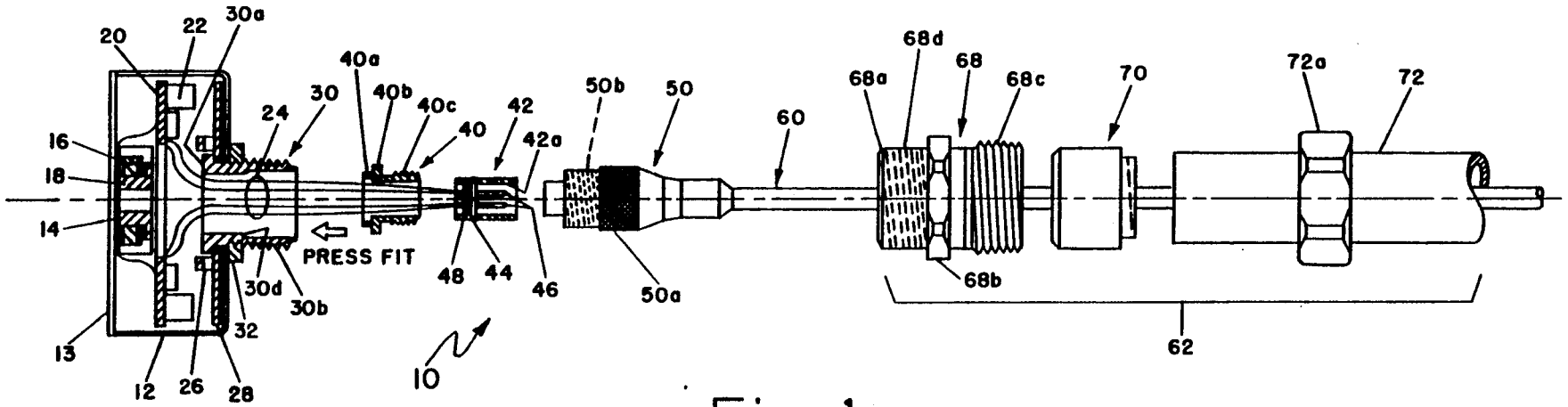
FIG. 1 is an exploded lateral view, shown partially in phantom, of a ruggedized, sealed quick disconnect coupler in accordance with the principles of the present invention.
Figure 3:
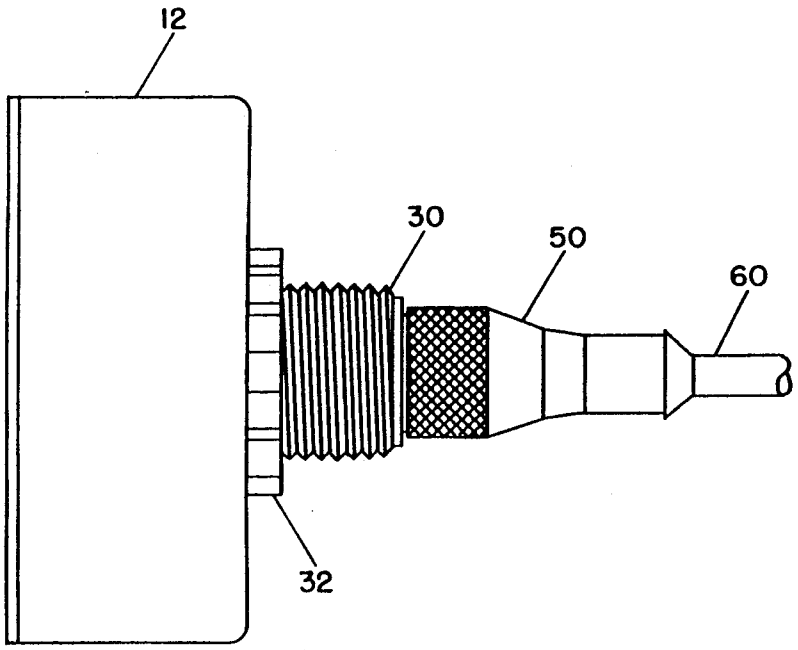
FIG. 3 is a side plan view of the assembled quick disconnect electrical coupler of FIG. 2.
Figure 2:
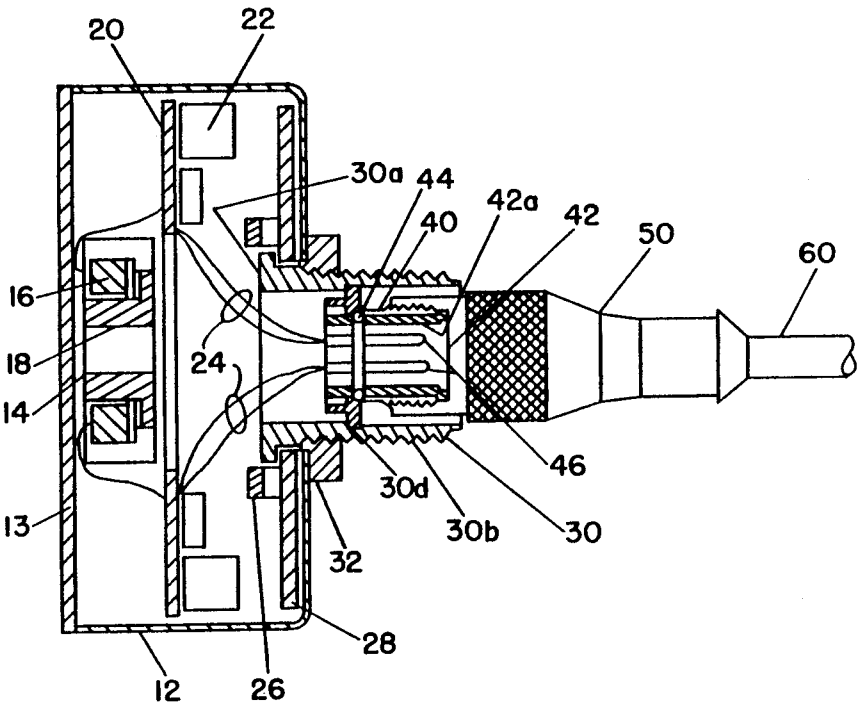
FIG. 2 is a lateral view, also shown partially in phantom, of a portion of an assembled ruggedized, sealed quick disconnect electrical coupler in accordance with the present invention.

Referring to FIG. 1, there is shown an exploded side view of a ruggedized, sealed quick disconnect electrical coupler 10 in accordance with the present invention. The left-hand portion of the electrical coupler 10 is shown in phantom in order to illustrate additional details of the invention. A portion of the assembled quick disconnect electrical coupler is shown partially cutaway in FIG. 2 and in a lateral plan view in FIG. 3.

The quick disconnect electrical coupler 10 connects an electrical cable, or cord, 60 to a sensor 12. The sensor 12 includes a housing 13 typically comprised of metal or plastic. The housing 13 is generally closed, having an aperture therein within which is positioned a conduit adapter 30. Disposed within housing 13 is a sensor 14 such as of the electromagnetic type including a coil, or windings, 16 and a ferrite core 18. Coil 16 is electrically coupled to various electronic components, or circuitry, 22 disposed on a printed circuit (PC) board 20 within sensor housing 13. A plurality of conductors 24 are electrically coupled to the electronic components 22 and terminate in a plurality of conductive pins 46 disposed within a connector housing 42.

Figure 4B:
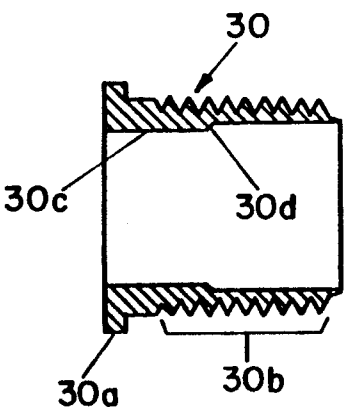
FIGS. 4*a* and 4*b* are respectively end-on and lateral sectional views of a conduit adapter used in one embodiment of the quick disconnect electrical coupler of the present invention.
Figure 4A:
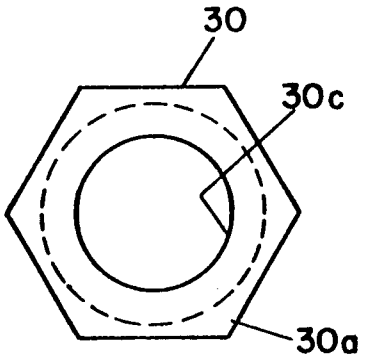

The electrical leads 2 extend out of the aperture of the sensor housing 13 and are disposed within the conduit adapter 30. Details of the conduit adapter 30 are shown in the end-on and lateral sectional views of FIGS. 4*a* and 4*b*. The conduit adapter 30 includes an aperture, or slot, 30*c* extending the length thereof through which the electrical leads 24 extend. Conduit adapter 30 further includes a hex nut, or flange, 30*a* on a first end thereof and a threaded portion 30*b* on a second; opposed end portion thereof. The threaded portion 30*b* is disposed on an outer surface of the conduit adapter 30, while an inner shoulder 30*d* is disposed within the conduit adapter's aperture 30*c*. Threads 30*b* are a standard tapered pipe thread which form a liquid-tight seal when connected to a mating female thread in a preferred embodiment.

Also disposed within sensor housing 13 is a reinforcing, or stiffener, plate 28. Reinforcing plate 28 also includes an aperture therein which is aligned with the aperture in sensor housing 13. Reinforcing plate 28 is preferably comprised of metal or a high strength plastic for increasing the strength and ruggedness of the coupler installation. Disposed on an inner surface of reinforcing plate 28 about the aperture therein are a plurality of ears 26. Ears 26 are disposed in closely spaced relation about the hex nut end 30*a* of the conduit adapter 30 to prevent rotation of the conduit adapter when threadably engaged by means of a lock nut 32. Tightening of lock nut 32 on the threaded portion 30*b* of conduit adapter 30 outside of sensor housing 13 allows for secure attachment of the conduit adapter to the sensor housing 13 in a liquid-tight seal. The secure attachment of the conduit adapter 30 to sensor housing 13 also protects the electrical leads 24 and various components of the electrical coupler disposed within the conduit adapter from damage by impact forces.

Figure 5B:
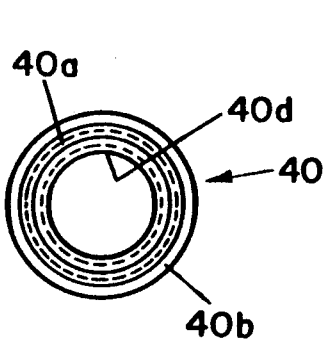
FIGS. 5*a* and 5*b* are respectively lateral sectional and end-on views of a connector adapter used in one embodiment of the quick disconnect electrical coupler of the present invention.
Figure 5A:
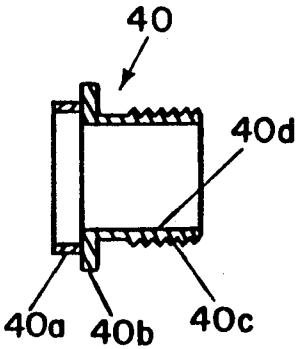

Disposed within the aperture 30*c* of the conduit adapter 30 is a connector adapter 40. Connector adapter 40 is also generally cylindrical in shape and includes an aperture 40*d* extending the length thereof as shown in the lateral sectional and end-on views of the connector adapter of FIGS. 5*a* and 5*b*. Connector adapter 40 further includes a first end 40*a*, a second threaded end portion 40*c*, and an outer flange 40*b* disposed therebetween. With connector adapter 40 inserted in the aperture 30*c* of conduit adapter 30, the connector adapter's flange 40*b* engages the inner shoulder 30*d* of the conduit adapter in a sealed manner. Connector adapter 40 is preferably press fit into secure engagement with conduit adapter 30 to ensure secure coupling between these two components.

Inserted within the aperture 40*d* of the connector adapter 40 is a connector housing 42. Connector housing 42 is also generally cylindrical in shape and includes an aperture 42*a* extending the length thereof. Disposed within connector housing 42 is a spacer, or partition, 48 having a plurality of apertures therein. Each of the apertures within spacer 48 is adapted to receive and engage a conductive pin 46. Each of the pins 46 is coupled at one end thereof to a respective one of the electrical leads 24 extending from the electronic components 22 on the PC board 20. Spacer 48 maintains the conductive pins 46 in fixed position within the connector housing 42 and ensures proper spacing between these pins. Spacer 48 also supports and maintains fixed positioning of the electrical leads 24 within the electrical coupler 10. An O-ring seal 44 is disposed on an outer portion of connector housing 42 and is adapted for secure engagement with an inner portion of connector adapter 40 when the connector housing is inserted into the connector adapter. The inner wall of the connector adapter 40 as well as the outer wall of the connector housing 42 may be tapered to ensure tight-fitting engagement of O-ring seal 44 with these two members. O-ring seal 44 is preferably comprised of a high strength, compressible material such as neoprene, while connector adapter 40 and connector housing 42 are preferably comprised of metal or a high strength plastic material. As in the case of attachment of connector adapter 40 to conduit adapter 30, connector housing 42 is preferably press fit into the connector adapter.

Coupled to the connector adapter 40 is a plug-type lead connector 50. Lead connector 50 has at a first end a plurality of socket-like receptacles (not shown) each adapted for receiving and engaging a respective contact pin 46 in the connector housing 42. Lead connector 50 also includes at one end thereof an internal threaded portion shown in FIG. 1 in dotted line form for engaging and coupling to the threaded end portion 40*c* of the connector adapter 40. Lead connector 50 further includes an outer gripping portion 50*a* to facilitate rotational displacement of the lead connector in connecting and disconnecting it from connector adapter 40 and the contact pins 46 within the connector housing 42. Coupled in a conventional manner to the plug-like terminals of the lead connector 50 and extending from a second end thereof is the multi-conductor cable 60. Lead connector 50 allows for the quick coupling and decoupling of electrical cable 60 from the sensor assembly 12.

Disposed about electrical cable 60 is a sealed connector 62 of conventional design. Sealed connector 62 includes a connector body 68, a compressible ferrule 70, and a conduit 72. Connector body 68 includes a first end 68*a* having an internal threaded portion 68*d* adapted for engaging the threaded portion 30*b* of the conduit adapter 30. A hex nut flange 68*b* is disposed about the connector body 68 to facilitate rotational displacement of the connector body in connecting and disconnecting it from the conduit adapter 30. Disposed on a second, opposed end of the connector body 68 is an external threaded portion 68*c*. Connector body 68 further includes an elongated aperture extending the length thereof within which is positioned the electrical cable 60.

The second threaded end portion 68*c* of the connector body 68 is adapted to receive the compressible ferrule 70 as well as an end of conduit 72. A compression nut 72*a* disposed about conduit 72 is adapted for engaging the threaded portion 68*c* of the connector body 68. Tightening of compression nut 72*a* on the threaded end portion 68*c* of the connector body 68 provides a compression fit between connector body 68 and conduit 72. Compressible ferrule 70 is preferably comprised of brass or a plastic material. Ferrule 70 forms a seal between the connector body 68 and conduit 72, which also preferably is comprised of a metal or a high strength plastic material. The combination of conduit adapter 30 and the sealed connector 62 isolates electrical leads 24 and cable 60 as well as the connection therebetween from moisture and other external contaminants. It should be noted that the side views of the electrical coupler shown in FIGS. 2 and 3 do not include elements of the sealed connector 62 shown in FIG. 1 for simplicity.

Figure 6:
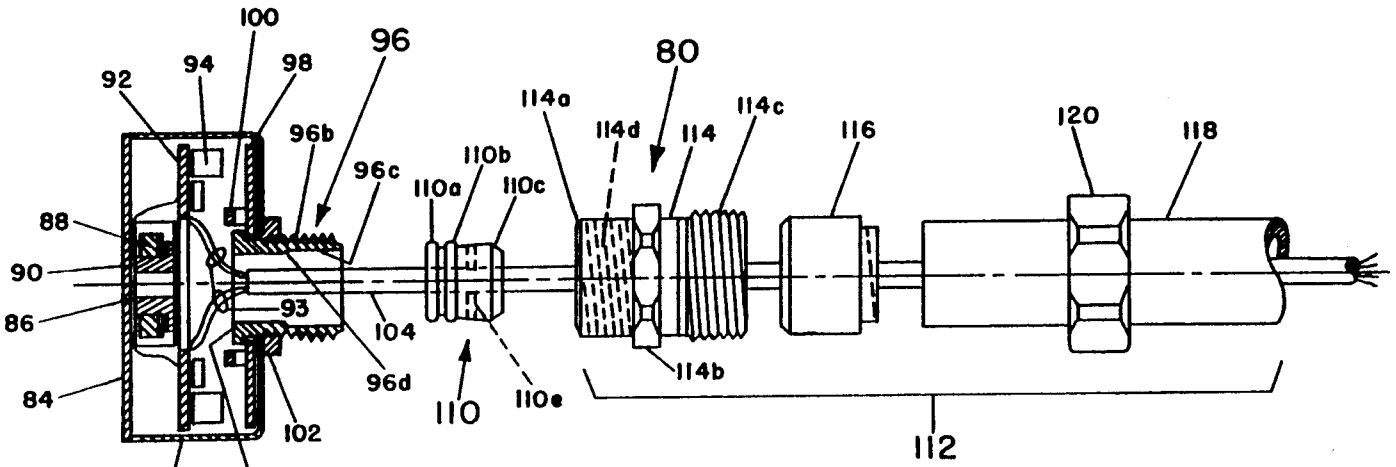
FIG. 6 is an exploded side view, shown partially in phantom, of another embodiment of a ruggedized, sealed electrical coupler in accordance with the present invention.
Figure 7B:
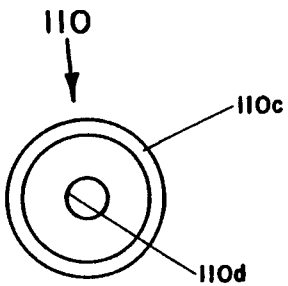
FIGS. 7*a* and 7*b* are respectively lateral and end-on views of a seal used in the embodiment of the invention shown in FIG. 6, where the lateral view is shown partially in phantom.
Figure 7A:
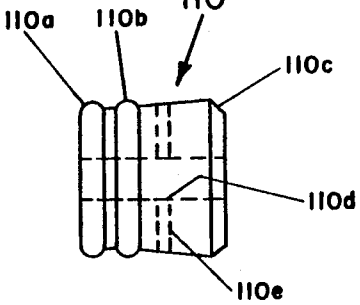

Referring to FIG. 6, there is shown a ruggedized, sealed electrical coupler 80 in accordance with another embodiment of the present invention. As in the previously described embodiment, the electrical coupler 80 shown in FIG. 6 is adapted for coupling an electrical cable 104 to circuitry 94 within a sealed sensor housing 82 in a moisture proof, ruggedized installation which protects the electrical components and conductors from mechanical damage as well as from exposure to external contaminants.

Sensor 82 includes a housing 84 within which are disposed an electromagnetic sensor 86 comprised of a coil 88 and a ferrite core 90. The coil 88 is electrically coupled to various electronic components, or circuitry, 94 on a PC board 92 within the sensor housing 84. Circuitry 94 is, in turn, coupled to a plurality of conductors 93 which extend through an aperture in sensor housing 84 and are disposed within cable 104.

As in the previous embodiment, a reinforcing plate 98 is disposed in contact with an interior wall of the sensor housing 84 and about an aperture therein. Attached to and extending from the reinforcing plate 98 are a plurality of spaced ears 100. Reinforcing plate ears 100 are positioned in closely spaced relation to a hex nut flange end portion 96*a* of a conduit adapter 96 positioned within the aperture of the sensor housing 84. The reinforcing plate ears 100 prevent rotation of the conduit adapter 96 when a threaded end portion 96*b* of the conduit adapter 96 is engaged by a lock nut 102. Tightening of lock nut 102 forms a moisture proof seal between sensor housing 84 and the conduit adapter 96.

Inner threads 114*d* on a first end portion 114*a* of a connector body 114 are adapted to engage the threaded portion 96*b* of the conduit adapter 96. A hex nut flange 114*b* disposed about the connector body 114 facilitates coupling the connector body to the conduit adapter 96 as well as its removal therefrom. A second, opposed end of the connector body 114 is provided with an external threaded portion 114*c* which is adapted for receiving a compression nut 120 disposed about a conduit 118. A compressible ferrule 116 inserted within connector body 114 and engaged by one end of conduit 118 forms a seal between the connector body and the conduit. The combination of connector body 114, compressible ferrule 116 and conduit 118 forms a sealed connector 112 with the conduit adapter 96 extending from sensor housing 84. As shown in FIG. 6, cable 104 is inserted through connector body 114, compressible ferrule 116 and conduit 118.

The ruggedized, sealed electrical coupler 80 further includes a seal 110 positioned within adjacent ends of the conduit adapter 96 and connector body 114. Seal 110 is generally cylindrical and includes an aperture extending the length thereof within which is positioned cable 104. Seal 110, which preferably is comprised of a high strength, compressible material such as neoprene, includes an internal spacer, or partition, shown in FIG. 6 in dotted-line form as element 110*e*, for engaging and maintaining proper spacing of cable 114 within conduit adapter 96 and sealed connector 112. Disposed on a first end of seal 110 is a first end O-ring 110*a* which is adapted for tight-fitting engagement with an inner shoulder 96*d* disposed within the aperture 96*c* of the conduit adapter 96. Seal 110 further includes a second intermediate O-ring 110*b* disposed along the length of the seal for similarly engaging the conduit adapter 96 about the aperture 96*c* therein. A second, opposed end 110*c* of seal 110 is provided with a bevelled edge to ensure tight-fitting engagement with an inner portion of connector body 114. In proceeding from the first O-ring 110*a* to the second end 110*c* of seal 110, the seal is tapered outward to further ensure tight sealing engagement between the seal and connector body 114. The combination of conduit adapter 96, seal 110 and sealed connector 112 provides a water tight and mechanically rugged connection for cable 114 to sensor circuitry 94.

Figure 8:
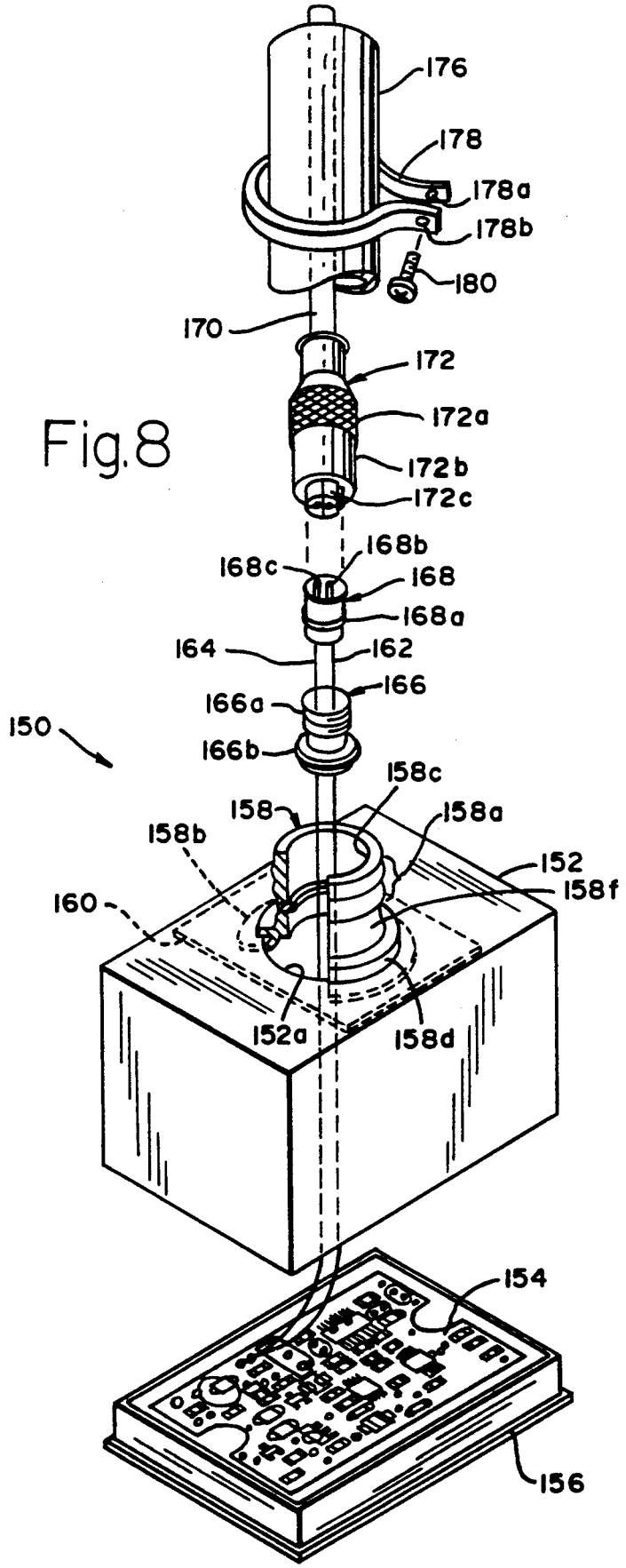
FIG. 8 is an exploded view shown partially in phantom of an electrical connector with a watertight fitting in accordance with another embodiment of the present invention.

Referring to FIG. 8, there is shown an exploded view partially in phantom of a watertight electrical coupler 150 in accordance with the present invention. FIG. 9 is an exploded side elevation view of the electrical coupler 150, while FIGS. 10 and 11 are side elevation views of the inventive electrical coupler respectively showing the connector's outer hose 176 in section and various inner connector components in phantom. Electrical coupler 150 is adapted for secure, sealed coupling to a housing 152 having an aperture 152*a* therein. Housing 152 is typically metallic and is adapted for enclosing a sensor circuit 154. As shown in the figure, sensor circuit 154 is mounted to a lower wall 156 of housing 152, with the wall adapted for secure, sealed attachment to the housing 152 for enclosing the sensor circuit 154.

Electrical coupler 150 provides an environmentally sealed electrical connection between the sensor circuit 154 and a multi-conductor cable 170 via first and second electrical leads 162 and 164. The electrical coupler 150 includes a generally cylindrically shaped hose fitting 158 including a first end having an outer barbed portion 158*a* and a second opposed end having a flange 158*b*. Hose fitting 158 further includes an aperture 158*c* through which the electrical leads 162 and 164 are inserted for passing through the aperture 152*a* in housing 152. Hose fitting 158 also includes an outer peripheral flange 158*d* which is adapted for positioning on the outer surface of housing 152 about the aperture 152*a* therein. The outer surface of the hose fitting's lower flange 158*b* is preferably knurled to provide more secure positioning within the housing's aperture 152*a* and prevent its rotation during assembly of the electrical coupler. In order to strengthen the attachment to housing 152 and make the installation more rugged, a backup plate 160 comprised of metal or a high strength plastic may be positioned on the inner surface of the housing about the aperture 152*a* therein. With the lower flange 158*b* of hose fitting 158 inserted through the aligned apertures in housing 152 and backup plate 160, the lower flange is rolled outwardly within the housing so as to securely engage the inner surface of the backup plate about its aperture. This provides a secure mechanical coupling between the hose fitting 158 and housing 152. A liquid adhesive such as urethane may be applied on the outer surface of the hose fitting's lower flange 158*b* to further increase the seal between hose fitting 158 and housing 152. Hose fitting 158 further includes a smooth outer portion 158*f* disposed intermediate barbs 158*a* and outer flange 158*d*.

Inserted within hose fitting 158 and aligned along its longitudinal axis is a generally cylindrically shaped connector housing 166. Plan and vertical sectional views of connector housing 166 are respectively shown in FIGS. 12*a* and 12*b*. Connector housing 166 includes an aperture 166*c* extending the length thereof through which the first and second electrical leads 162 and 164 pass. Connector housing 166 further includes a lower flange 166*d* adapted for tight fitting positioning within an aperture formed by an inner flange 158*e* of the hose fitting 158. The connector housing 166 also includes an outer threaded portion 166*a* and an outer shoulder 166*b*. Outer shoulder 166*b* is positioned in contact with the hose fitting's inner flange 158*e* when connector housing 166 is fully inserted within hose fitting 158.

Aperture 166*c* within connector housing 166 is adapted to receive a generally cylindrically shaped connector insert 168. Disposed within connector insert 168 are first and second contact pins 168*b* and 168*c* which are respectively coupled to the first and second electrical leads 162, 164. The first and second contact pins 168*b*, 168*c* are maintained securely in position within connector insert 168 by conventional means such as a spacer, or partition, 168*d* having a plurality of apertures therein adapted for receiving a respective contact pin. The contact pin supporting spacer 168*d* is shown on dotted line form in FIG. 9. Disposed about the outer periphery of connector insert 168 is an O-ring 168*a*. O-ring 168*a* disposed on connector insert 168 is adapted for tight fitting insertion within the aperture 166*c* in connector housing 166. A conventional sealant is preferably applied to O-ring 168*a* prior to insertion in connector housing 166 to provide an improved seal between the outer connector housing and the inner connector insert 168. O-ring 168*a* is preferably comprised of a high strength, compressible material such as neoprene.

A lead connector 172 is coupled to the end of the cable 170. Lead connector 172 is generally cylindrical and includes an outer knurled gripping portion 172*a*, an inner threaded portion 172*b*, and an end female lead connecting portion 172*c*. The female lead connecting portion 172*c* is adapted for insertion within connector insert 168 and includes a pair of spaced socket-like receptacles each adapted for engagement with one of the first and second contact pins 168*b*, 168*c*. Each of the conductive socket-like receptacles (which are not shown in the figures for simplicity) is, in turn, coupled to a respective conductor within cable 170. The inner threaded portion 172*b* of the lead connector 172 is adapted for positioning over the outer portion of the connector housing 166 and for engaging the outer threaded portion 166*a* thereof. Rotation of the lead connector in a first direction tightens the lead connector 172 on the connector housing 166 and draws the first and second contact pins 168*b*, 168*c* in intimate contact with the aforementioned conductive socket-like receptacles in the female lead connecting portion 172*c* of the lead connector 172. Rotation of the lead connector 172 in the opposite direction, permits the lead connector to be detached from the connector housing 166 in a quick disconnect manner.

The connector housing 166 is press fit into the hose fitting 158, while the connector insert 168 is preferably press fit into the connector housing. Hose fitting 158 is preferably comprised of stainless steel, while the connector housing 166 and connector insert 168 are also comprised of either a corrosion resistance metal or a high strength plastic material.

Disposed about cable 170 and lead connector 172 is a hose, or tube, 176 preferably comprised of vinyl or rubber. Hose 176 is inserted over the outer portion of hose fitting 158 so that the end of the hose is in contact with the hose fitting's outer flange, or shoulder, 158*d*. Hose 176 is thus positioned over barbs 158*a* and the smooth outer portion 158*f* of the hose fitting 158. Barbs 158*a* provide an interference fit with the inner surface of hose 176 and are sized so as to expand the hose as it is positioned on the hose fitting 158 so as to form a liquid seal. A clamp 178, preferably comprised of a high strength, resilient plastic, is adapted for positioning about hose 176 when inserted over hose fitting 158. The ends of clamp 178 are coupled by means of a threaded coupling pin, or screw, 180 for tightening clamp 178 about the outer periphery of hose 176. Clamp 178 engages hose 176 adjacent the smooth outer portion 158*f* of hose fitting 158 so as to draw the hose in intimate contact with the hose fitting's smooth outer portion to provide additional sealing strength as well as a positive mechanical attachment of the hose to the hose fitting.

There has thus been shown an electrical coupler with a watertight fitting adapted for connecting a multi-lead cable to circuitry within a closed housing through an aperture in a wall of the housing. The coupler includes an inner threaded multi-pin cable connector disposed within a barbed cylindrical hose fitting positioned in sealed contact with the aperture in the housing wall. A reinforcing plate may be attached to the hose fitting on the inner surface of the housing wall for increase strength and rigidity. A vinyl or rubber hose is inserted over the outer end portion of the hose fitting in a tight fitting manner, with the barbs on the hose fitting maintaining an interference fit with the inner surface of the hose and a clamp providing additional sealing strength as well as a positive mechanical attachment of the hose to the hose fitting. A threaded, quick disconnect electrical connector is disposed within the hose and provides an electrical connection between the multi-lead cable and leads from the circuitry within housing. A watertight seal is thus formed about the quick disconnect electrical connector and isolates the electrical connector as well as the circuitry within the closed housing from materials encountered in a hostile environment such as corrosive and caustic fluids under high pressures and at high temperatures.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A quick disconnect, watertight electrical coupler for connecting an electrical cable to leads from a sensor circuit within a housing, said electrical coupler comprising:

a hose fitting means coupled to the housing and disposed about an aperture therein for forming a seal with the housing, wherein the sensor leads pass through the aperture in the housing and are disposed within said hose fitting means, said hose fitting means including a cylindrical body having a first end portion with a plurality of circumferential barbs disposed in a spaced manner along a portion of the length thereof outside of the housing;

hose means disposed about the electrical cable for forming a watertight seal thereabout, wherein an end of said hose means is inserted over and securely engages said barbs on said hose fitting means;

clamp means for securely engaging said hose means intermediate said barbed end portion thereof and said housing for forming a watertight seal between said hose means and said hose fitting means;

quick disconnect coupling means for connecting the electrical cable to the senor leads; and connector housing means for coupling the sensor leads to said quick disconnect coupling means, wherein said connector housing means is in sealed engagement with said hose fitting means and said quick disconnect coupling means and engages and maintains the sensor leads in fixed position within the electrical coupler.

2. The electrical coupler of claim 1 wherein said hose fitting means includes a second flanged end disposed within the sensor housing, and wherein an outer surface of said flanged end is knurled.

3. The electrical coupler of claim 2 wherein said second flanged end of said hose fitting means is rolled outward so as to engage in inner surface of the housing around the aperture therein.

4. The electrical connector of claim 1 further including reinforcing means disposed within the sensor housing and about the aperture therein for strengthening a wall of the sensor housing adjacent to said hose fitting means, and wherein a second flanged end of said hose fitting means is rolled outward so as to engage in inner surface of said reinforcing means.

5. The electrical connector of claim 4 wherein said reinforcing means comprises a generally flat plate having an aperture therein through which said hose fitting means extends.

6. The electrical coupler of claim 1 wherein said connector housing means includes an inner connector insert disposed about and engaging said sensor leads and an outer connector housing disposed about said connector insert and in sealed engagement with said hose fitting means and said quick disconnect coupling means.

7. The electrical coupler of claim 6 wherein said quick disconnect coupling means includes a female lead connector coupled to the electrical cable.

8. The electrical coupler of claim 7 wherein said quick disconnect coupling means further includes first and second threaded portions disposed respectively on said outer connector housing and said female lead connector.

9. The electrical coupler of claim 8 wherein said outer connector housing is disposed within said hose fitting means and includes outer shoulder means for engaging an inner portion of said hose fitting means in a sealed manner.

10. The electrical coupler of claim 9 wherein said inner connector insert is disposed within and engages said outer connector housing in a sealed manner.

11. The electrical coupler of claim 10 further comprising seal means disposed intermediate and in sealed contact with said inner connector insert and said outer connector housing.

12. The electrical coupler of claim 11 wherein said seal means includes an O-ring.

13. The electrical coupler of claim 12 wherein said inner connector insert further includes a plurality of pins each coupled to a respective sensor lead and adapted for coupling to said female lead connector.

14. The electrical coupler of claim I wherein said hose means is comprised of rubber or vinyl tubing.

15. The electrical coupler of claim 1 wherein said clamp means includes, in combination, a clamp disposed about said hose means and means for securely engaging respective ends of said clamp and drawing said clamp tightly around said hose means.

16. The electrical coupler of claim 15 wherein said means for securely engaging respective ends of said clamp includes a threaded screw.

17. The electrical coupler of claim 1 wherein said hose fitting means further includes a smooth portion disposed intermediate the barbed end portion thereof and said housing, and wherein said clamp means engages and compresses said hose means on the smooth portion of said hose fitting means.

18. A quick disconnect, watertight electrical coupler for connecting an electrical cable to leads from a sensor circuit within a housing, said electrical coupler comprising:

a hose fitting coupled to the housing and disposed in a tight-fitting manner in an aperture therein so as to form a seal with the housing, wherein the sensor leads pass through the aperture in the housing and are disposed within said hose fitting, said hose fitting including a first outer ribbed end portion, a peripheral flange engaging an outer surface of the housing about the aperture therein, an outer smooth portion disposed intermediate said ribbed end portion and said flange, and an end flange disposed on a second opposed end of hose fitting and inserted through the aperture in the housing, wherein said end flange is rolled outward so as to engage an inner surface of the housing around the aperture therein to form a watertight seal;

a hose inserted over said hose fitting in a friction fit, wherein said ribbed end portion of said hose fitting engages an inner portion of said hose and expands said hose to form a watertight seal;

a clamp disposed about and engaging said hose for tightly compressing said hose against the smooth outer portion of said hose fitting; and a quick disconnect electrical coupler disposed within said hose in a watertight manner for connecting the electrical cable to the sensor circuit leads.

* * * * *

UNITED STATES PATENT AND TRADEMARK OFFICE

CERTIFICATE OF CORRECTION

PATENT NO. : 5,302,138

DATED : April 12, 1994

INVENTOR(S) : Winston E. Shields

It is certified that error appears in the above-identified patent and that said Letters Patent is hereby corrected as shown below:

| COLUMN | LINE | |
|---|---|---|
| 3 | 50 | "2" should be --24-- |
| 10 | 44 | "I" should be --1-- |

Signed and Sealed this

Twenty-sixth Day of July, 1994

Bruce Lehman

*Attest:*

BRUCE LEHMAN

*Attesting Officer*

*Commissioner of Patents and Trademarks*